US005740828A

United States Patent [19]

Evans

[11] Patent Number: 5,740,828

[45] Date of Patent: Apr. 21, 1998

[54] COLLAPSIBLE SHELTERS

[76] Inventor: Evan J. Evans, 207 P.R. 2593, Alvord, Tex. 76225

[21] Appl. No.: 853,247

[22] Filed: May 9, 1997

[51] Int. Cl.[6] ..... E04H 15/44

[52] U.S. Cl. ..... 135/132; 135/133

[58] Field of Search ..... 135/128, 130, 135/129, 132, 133, 135, 136, 137, 147, 148, 144, 116

[56] References Cited

U.S. PATENT DOCUMENTS

| | | | |
|---|---|---|---|
| 1,289,965 | 12/1918 | Tichenor | 135/133 X |
| 1,519,691 | 12/1924 | Mizrahi | 135/133 X |
| 2,992,649 | 7/1961 | Swallow | 135/133 |
| 3,161,231 | 12/1964 | Dawson et al. | 135/132 X |
| 3,845,591 | 11/1974 | Stine | 135/129 X |

FOREIGN PATENT DOCUMENTS

| | | | |
|---|---|---|---|
| 500162 | 3/1920 | France | 135/133 |
| 1325748 | 3/1963 | France | 135/132 |

*Primary Examiner*—Lanna Mai
*Attorney, Agent, or Firm*—Martin Sachs

[57] ABSTRACT

A collapsible shelter includes an arcuate roof section which includes a left and a right edge having a downwardly extending lip portion. A plurality of left and right arcuate sections have a left edge provided with a downwardly extending lip portion and a right edge with an upwardly extending lip portion adapted to cooperate with downwardly extending lip portions of the arcuate roof section. The remaining left and right arcuate sections have a left edge provided with a downwardly extending lip portion and a right edge provided with an upwardly extending lip portion for cooperating with the downwardly extending lip portion of a previous left and right arcuate section. The base section has an arcuate extending base member and an upwardly extending lip adapted to cooperate with the downwardly extending lip portion of a left section. An arcuate door section has a door member portion that mates with the base member extending portion that may include locking means to prevent the dome shelter from collapsing. All of the arcuate sections terminate in end portions provided with an aperture proximate the distal ends thereof. A pair of bolts, one of which is placed through one of the apertures provided on the sections, locks the units together in a nesting manner and a second bolt locks the other apertures provided on the section members. Each of the sections nest within another section when the unit is completely extended and collapse to essentially the width of the roof section.

15 Claims, 3 Drawing Sheets

COLLAPSIBLE SHELTERS

BACKGROUND OF THE INVENTION

1. Field of the Invention

The present invention relates generally to collapsible dome shelters and more particularly, to shelters that serve as wind breakers or provide shade or shelter for persons desiring protection from the elements. The present invention more specifically relates to a shelter for small vehicles such as motorcycles or alternatively, may be used to store personal property that may be hidden from vandals.

2. Discussion of the Relevant Art

The art abounds with many different types of portable and collapsible shelters used for many different purposes. Typical of these shelters is disclosed in U.S. Pat. No. 3,190,300 issued to Wear'n on Jun. 22, 1965, which discloses a portable shelter for use on the beach, patio or lakeside. It is collapsible, lightweight and serves a limited function.

Another collapsible shelter is disclosed in U.S. Pat. No. 2,266,853 to Dabney, which issued on Dec. 23, 1941. Here again the device does not completely close and is light in weight. Yet another foldable canopy as disclosed in U.S. Pat. No. 3,121,439 issued to Moltchan on Feb. 18, 1964, which is light in weight and merely acts as cover for sun and a shelter from the rain.

SUMMARY OF THE INVENTION

The prior art discussed above may be readily suitable for shelter from the wind and the rain. However, these apparatuses are not suitable for storing a vehicle, such as a motorcycle, which is to be secure when the owner thereof is not present. The primary purpose of the instant apparatus is to provide a small, not particularly light, protective housing for a vehicle, which would not be in view, for vandals to attempt to steal. The apparatus of the instant invention overcomes the shortcomings of the prior art by providing a structure, which may be made secure and is available for transporting to another location, if desired, by collapsing the unit to its smallest dimensions.

Accordingly, it is the primary object of the present invention to provide a full weather shelter for a small vehicle and when expanded will conceal whatever is placed therein.

It is another object of the present invention to provide a portable structure to house a small vehicle, which is not readily accessible to vandals.

Yet another object of the present invention is to provide a portable apparatus with sufficient rigid structure to withstand the atmospheric elements and protect anything that is housed therein.

The present invention overcomes the shortcomings found in prior art by providing a secure portable housing to protect a vehicle such as a motorcycle from the weather or vandals.

The foregoing and other objects and advantages will appear from the description to follow.

In the description reference is made to the accompanying drawing, which forms a part hereof and which is shown by way of illustration a preferred embodiment in which the invention may be practiced. The preferred embodiment will be described in sufficient detail to enable those skilled in the art to practice the invention, and it is to be understood that other embodiments may be utilized and that some changes may be made without departing from the spirit and scope of the present invention. The following detailed description is, therefore, not to be taken in a limiting sense but the scope of the invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
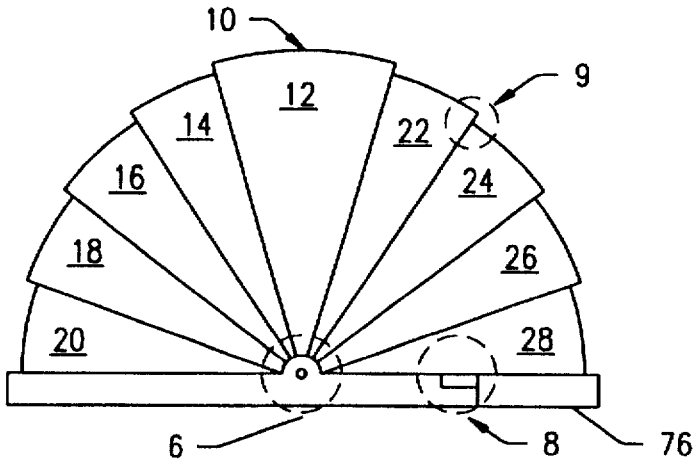
FIG. 1 is a side view, in elevation, of the collapsible dome shelter fully extended, according to the principles of the present invention.
Figure 2:
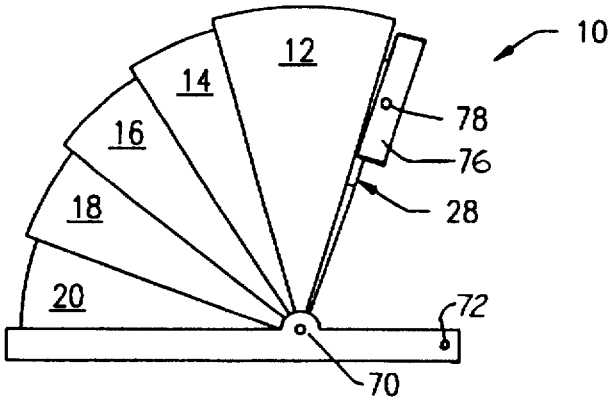
FIG. 2 is a side view, in elevation, of the collapsible shelter half opened so that a vehicle may be placed therein.
Figure 3:
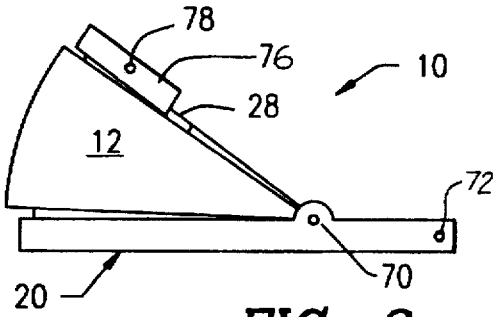
FIG. 3 is a side view, in elevation, of the position of the collapsible shelter in its collapsed position.

Referring now to the figures, and in particular, to FIG. 1 there is shown a collapsible dome shelter 10, which includes a roof section 12 and 3 left sections 14, 16 and 18 and a base section 20, which nest and cooperate with each other in a manner, which will be described hereinafter. In addition, are included three right sections 22, 24 and 26 and a door section 28, which nest or cooperate with each other in the same manner as sections 14, 16, 18 and 20. FIGS. 2 and 3 show the collapsible dome shelter 10 in various stages of being collapsed such as one half position, shown in FIG. 2 and completely collapsed as shown in FIG. 3, where it collapses down essentially to the dimension of the roof section 12.

Figure 4:
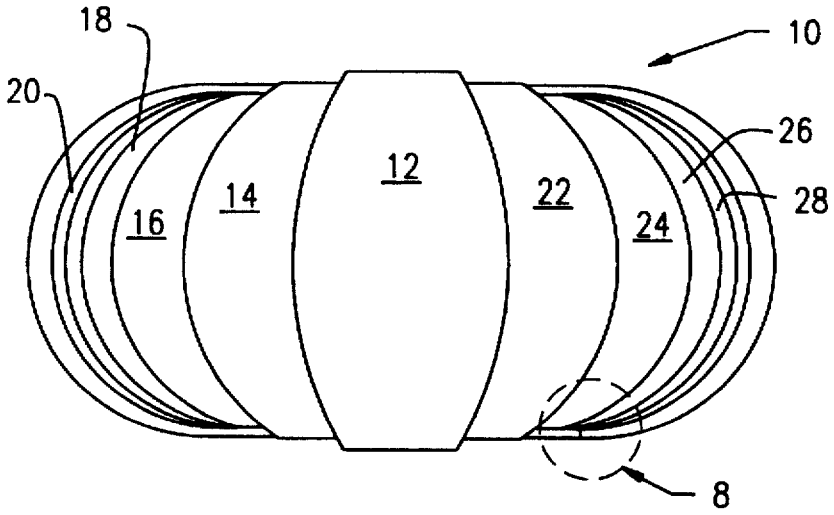
FIG. 4 is a top plan view of the collapsible shelter as shown in FIG. 1.
Figure 5:
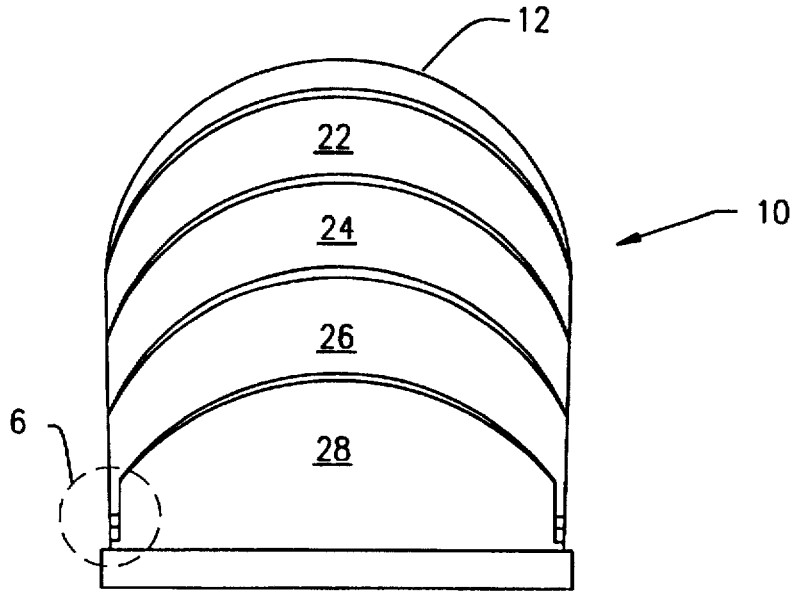
FIG. 5 is an end view, in elevation, of the apparatus shown in FIG. 1.

FIGS. 4 and 5 are top plan views and right elevational views, respectively, of the dome shelter 10 in the fully extended position.

Figure 9:
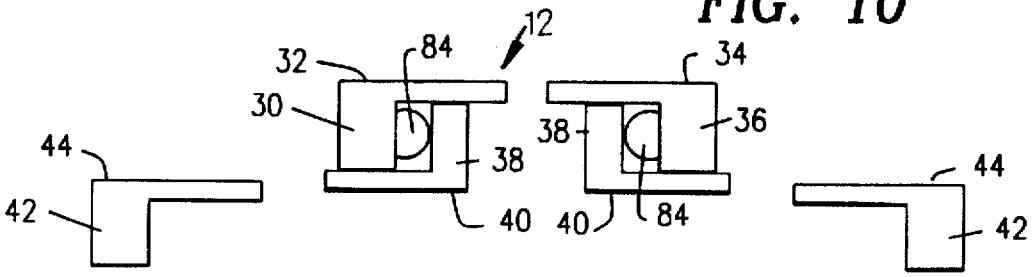
FIG. 9 is an enlarged view of the area shown in FIG. 1, showing the sealing gasket between the mating surfaces of the individual sections.

The roof section 12 is provided with a downwardly extending lip portion 30 (shown in FIG. 9), extending along its left edge 32 and along its right edge 34 is provided a downwardly extending lip portion 36. The left sections 14, 16 and 18 are provided with an upwardly extending lip portion 38 along one edge 40 and a downwardly extending lip portion 42 along the other edge 44 as shown in FIG. 9. Thus, the roof section 12 is provided with a downwardly extending lip portion 30 and 36 along edges 32 and 34. Each of the other sections 12, 14, 16 and 18 as well as 22, 24 and 26 are provided with an upwardly extending portion 38 along one edge 40 and a downwardly extending lip portion 42 at the other edge 44, thereby providing a nesting arrangement when the collapsible dome shelter 10 is assembled.

Figure 10:
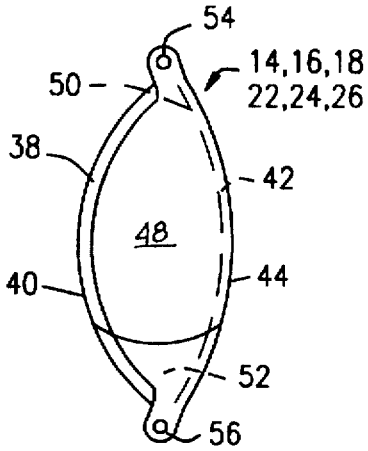
FIG. 10 is a top plan view of one of the sections extended in one plane.

Referring now to FIG. 10, which is a top plan view of the arcuate sections 14, 16, 18, 22, 24 and 26 positioned on a flat surface may be seen to include a central portion 48, which terminate in first and second end portions 50 and 52, respectively. The distal end of end portions 50 and 52 are provided with through apertures 54 and 56. Although the sections 14, 16, 18, 22, 24 and 26 have been shown as being arcuate in shape, it will be obvious to those knowledgeable in the art that this is not a necessary requirement and the shape may be varied in accordance with the desire to obtain a particular external shape of the collapsible shelter.

The end portions 50 and 52 of sections 14, 16, 18, 22, 24 and 26 are provided with through apertures 54 and 57. Since the left and right sections are preferably fabricated from fiberglass, washers 58, preferably fabricated from steel, are embedded therein along the relatively narrow end portions 50 and 52 to add structural strength thereto.

Figure 6:
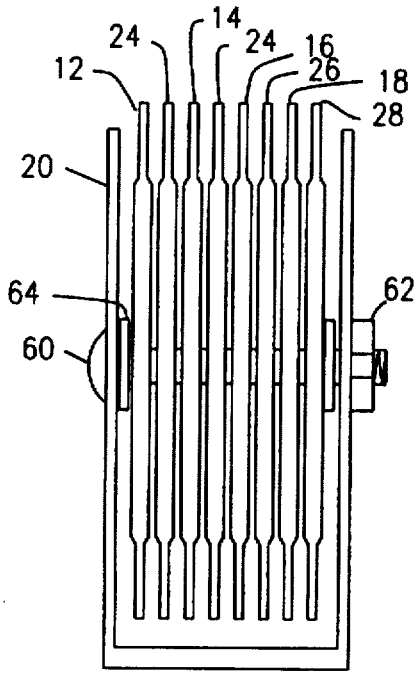
FIG. 6 is an enlarged view of the area shown in FIG. 5 showing the assembly manner of the individual sections.
Figure 7:
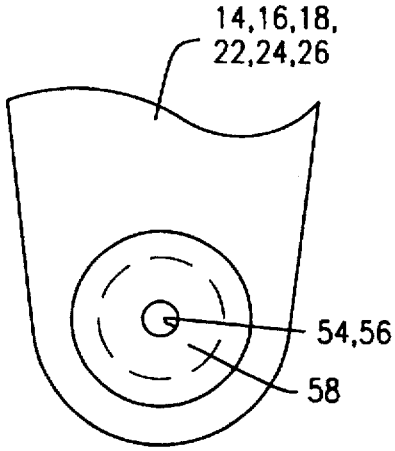
FIG. 7 is an enlarged view of the distal end of the sections shown in FIG. 6.

Referring now to FIG. 6 one may see the method of mounting the sections are performed. The assembly method includes a metal stove bolt 60 to hold the weight of the arcuate sections, which are kept in position by a nut 62. A nylon washer 64 may be placed between each of the sections to allow for ease of movement of the sections when extending and collapsing the collapsible dome shelter 10.

Figure 8:
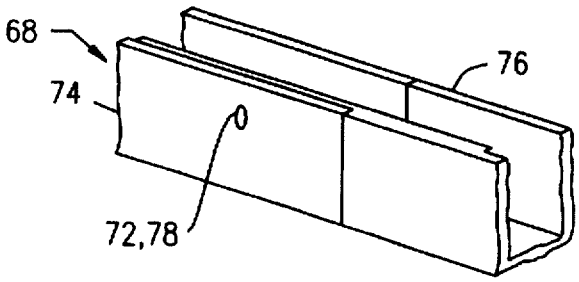
FIG. 8 is an enlarged view, in perspective, of the cooperating portions of the base and door sections, wherein a locking device may be utilized.

Referring now to FIG. 8, which shows the base section 20 having an arcuate base member portion 68 with a centrally disposed aperture 70 (see FIGS. 2 and 3) and a second aperture 72 disposed approximately three quarters of the length of the base member portion 68 on an extending portion 74. The right edge of the base section 20 is provided with an upwardly extending lip portion 38 along the edge 40 for cooperating with the downwardly extending lip portion of a left section 18.

The arcuate door section 28 has a left edge provided with a door member portion that has a right edge 76 that mates with the base member extending portion 74, which is provided with a centrally disposed aperture 78 designed to coincide with aperture 72 into which may be placed a locking means, not shown, suitable for preventing the dome 10 from being collapsed.

The other edge of door section 28 is provided with an upwardly extending portion 38 along edge 40 (see FIG. 9) to cooperate with the downwardly extending lip portion 36 of a prior section 26.

It will be understood that various changes in the details, materials, arrangements of parts and operating conditions, which have been herein described and illustrated in order to explain the nature of the invention may be made by those skilled in the art within the principles and scope of the instant invention.

Hereinbefore has been disclosed a collapsible shelter suitable for safely housing a small vehicle, such as a motorcycle, lawnmower, etc., as well as, other valuables and protect them from the weather and access by vandals. The overlapping lip portions are provided with a gasket 84, preferably of rubber-like material, which helps seal the unit from ambient moisture.

Having thus set forth the nature of the invention, what is claimed is:

1. A collapsible shelter comprising:

A. a roof section including, a) a central portion terminating in first and second end portions, each said end portions being provided with an aperture proximate the distal end thereof, and b) a left and a right edge, said left and said right edge, being provided with a downwardly extending lip portion;

B. a plurality of left and right sections having, a) a central portion terminating in first and second end portions, each said end portions being provided with an aperture proximate the distal end thereof, and b) a left and a right edge, said left edge being provided with a downwardly extending lip portion and said right edge being provided with an upwardly extending lip portion, and c) said left edge of said left and right sections upwardly extending lip portions cooperating with said downwardly extending lip portions of said roof section;

C. each of the remaining left and right sections having, a) a central portion terminating in first and second end portions, each said end portions being provided with an aperture proximate the distal end thereof, b) a left and a right edge, said left edge, being provided with a downwardly extending lip portion and said right edge being provided with an upwardly extending lip portion, and c) said left edge of said left and right section upwardly extending lip portion cooperating with said downwardly extending lip portion of a previous left and right section;

D. a base section having, a) a central portion terminating in first and second end portions, b) a left and a right edge, said left edge being provided with a base member portion having a first centrally disposed aperture and a second aperture disposed approximately three quarters the length of said base member portion on an extending portion, said right edge being provided with an upwardly extending lip portion, and c) said right edge of said base section upwardly extending lip portion cooperating with said downwardly extending lip portion of a left section; and E. a door section having, a) a central portion terminating in first and second end portions, and b) a left and a right edge, said right edge being provided with a door member portion that mates with said base member extending portion of said base member section and is provided with a centrally disposed aperture, said left edge being provided with an upwardly extending lip portion;

F. first mounting bolt means disposed within one said distal end aperture of all said sections slidably retaining them therein in a nesting manner;

G. second mounting bolt means disposed within the other of said distal end aperture of all said sections slidably retaining them therein in a nesting manner, and H. retaining means for holding each said mounting bolt means within said distal end apertures;

wherein all said sections cooperating with each other to form said shelter when extended and collapse to essentially the width of said roof section.

2. A collapsible shelter according to claim 1, wherein said shelter is in the form of a hemisphere when extended.

3. A collapsible shelter according to claim 1, wherein said shelter has three left sections and three right sections.

4. A collapsible shelter according to claim 1, wherein said second aperture disposed in said base member extending portion is in alignment with said door section central aperture.

5. A collapsible shelter according to claim 4, wherein said second aperture disposed in said base member extending portion and said door section central aperture having a locking device therein.

6. A collapsible shelter according to claim 1, wherein said first mounting bolt means and said second mounting bolt means include washers disposed between all said sections.

7. A collapsible shelter according to claim 1, wherein a sealing means is provided between the mating surfaces of said upwardly extending lip portions and said cooperating downwardly extending lip portions of said sections.

8. A collapsible dome shelter in the form of a hemisphere comprising:

A. an arcuate roof section including, a) said arcuate roof section terminating in first and second end portions, each said end portions being provided with an aperture proximate the distal end thereof, and b) a left and a right edge, said left and said right edge, being provided with a downwardly extending lip portion;

B. a plurality of left and right arcuate sections terminating in first and second end portions, each said end portions being provided with an aperture proximate the distal end thereof, said left and right arcuate sections having a left edge provided with a downwardly extending lip portion and a right edge with an upwardly extending lip portion, said left edge of said left and right sections upwardly extending lip portions cooperating with said downwardly extending lip portions of said arcuate roof section;

C. each of the remaining left and right arcuate sections terminate in first and second end portions provided with an aperture proximate the distal end thereof, said remaining left and right arcuate sections having a left edge provided with a downwardly extending lip portion, a right edge provided with an upwardly extending lip portion for cooperating with said downwardly extending lip portion of a previous left and right arcuate section;

D. an arcuate base section terminating in first and second end portions having a left edge provided with an arcuate base member portion having a first centrally disposed aperture and a second aperture disposed approximately three quarters the length of said arcuate base member portion on an extending portion, said right edge being provided with an upwardly extending lip portion for cooperating with said downwardly extending lip portion of a left section; and E. an arcuate door section terminating in first and second end portions having a left and a right edge provided with a door member portion that mates with said arcuate base member extending portion of said arcuate base member section and is provided with a centrally disposed aperture, said left edge being provided with an upwardly extending lip portion;

F. first mounting bolt means disposed within one said distal end aperture of all said sections slidably retaining them therein in a nesting manner;

G. second mounting bolt means disposed within the other of said distal end aperture of all said sections slidably retaining them therein in a nesting manner; and H. retaining means for holding each said mounting bolt means within said distal end apertures;

wherein all said arcuate sections cooperating with each other to form said dome shelter when extended and collapse to essentially the width of said roof section.

9. A collapsible dome shelter according to claim 8, wherein said shelter is in the form of a hemisphere when extended.

10. A collapsible dome shelter according to claim 8, wherein said dome shelter has three arcuate left sections and three arcuate right sections.

11. A collapsible dome shelter according to claim 8, wherein said second aperture disposed in said arcuate base member extending portion is in alignment with said arcuate door section central aperture.

12. A collapsible dome shelter according to claim 11, wherein said second aperture disposed in said base member extending portion and said door section central aperture having a locking device therein.

13. A collapsible dome shelter according to claim 8, wherein said first mounting bolt means and said second mounting bolt means include washers disposed between all said sections.

14. A collapsible dome shelter according to claim 8, wherein a sealing means is provided between the mating surfaces of said upwardly extending lip portions and said cooperating downwardly extending lip portions of said arcuate sections.

15. A collapsible shelter comprising:

A. a roof section terminating in first and second end portions provided with an aperture proximate the distal end thereof having a left edge and a right edge provided with a downwardly extending lip portion;

B. a plurality of left and right sections terminating in first and second end portions provided with an aperture proximate the distal end thereof with a left edge provided with a downwardly extending lip portion and a right edge provided with an upwardly extending lip portion, said right edge upwardly extending lip portions cooperating with said downwardly extending lip portions of said roof section;

C. each of the remaining left and right sections terminating in first and second end portions provided with an aperture proximate the distal end thereof with a left edge provided with a downwardly extending lip portion and a right edge provided with an upwardly extending lip portion, said left edge of said left and right section upwardly extending lip portion cooperating with said downwardly extending lip portion of a previous left and right section;

D. a base section terminating in first and second end portions, a left and a right edge, said left edge being provided with a base member portion having a first centrally disposed aperture and a second aperture disposed approximately three quarters the length of said base member portion on an extending portion, said right edge being provided with an upwardly extending lip portion, said right edge of said base section upwardly extending lip portion cooperating with said downwardly extending lip portion of a left section; and E. a door section terminating in first and second end portions, a left and a right edge, said right edge being provided with a door member portion that mates with said base member extending portion of said base member section and is provided with a centrally disposed aperture, said left edge being provided with an upwardly extending lip portion;

F. first mounting bolt means disposed within one said distal end aperture of all said sections slidably retaining them therein in a nesting manner;

G. second mounting bolt means disposed within the other of said distal end apertures of all said sections slidably retaining them therein in a nesting manner; and H. retaining means for holding each said mounting bolt means within said distal end apertures;

wherein all said sections cooperating with each other to form said shelter when extended and collapse to essentially the width of said roof section.

* * * * *